US005147728A

United States Patent [19]

Tanaka et al.

[11] Patent Number: 5,147,728

[45] Date of Patent: Sep. 15, 1992

[54] AG-$SNO_2$ ELECTRICAL CONTACT MATERIALS

[76] Inventors: Seiichi Tanaka, 13/7, Kitasenzoku 2-chome, Ohta-ku, Tokyo; Teruo Hirata, 19/53, Wakamatsu-cho 2-chome, Toshima-ku, Tokyo; Masaharu Yida, Suite 6-602, No. 9, Nakameguro 2-chome, Meguro-ku, Tokyo, all of Japan

[21] Appl. No.: 726,314

[22] Filed: Jul. 5, 1991

Related U.S. Application Data

[62] Division of Ser. No. 477,347, Feb. 8, 1990, Pat. No. 5,078,810.

[30] Foreign Application Priority Data

Jan. 26, 1990 [JP] Japan ..... 2-17514

[51] Int. Cl.[5] ..... C22C 5/00

[52] U.S. Cl. ..... 148/431; 428/929; 428/614; 420/501

[58] Field of Search ..... 148/431, 20.3; 428/614

[56] References Cited

U.S. PATENT DOCUMENTS

| | | | |
|---|---|---|---|
| 4,412,971 | 11/1983 | Shibata | 148/431 |
| 4,452,652 | 6/1984 | Shibata | 148/431 |
| 4,457,787 | 7/1984 | Shibata | 148/431 |
| 4,981,533 | 1/1991 | Yida | 148/431 |

FOREIGN PATENT DOCUMENTS

| | | | |
|---|---|---|---|
| 0090132 | 8/1978 | Japan | 148/431 |
| 0100914 | 9/1978 | Japan | 148/431 |
| 0036636 | 2/1985 | Japan | 148/431 |

*Primary Examiner*—Upendra Roy

*Attorney, Agent, or Firm*—Shlesinger, Fitzsimmons & Shlesinger

[57] ABSTRACT

Novel Ag-SnO electrical contact materials are disclosed, which are made of Ag alloys consisting of 5–20 weight % of Sn and a balance of Ag, the alloys having been prepared by melting and having been internal oxidized. Novel manufacturing methods are also disclosed, in which internal-oxidation is conducted in an oxygen atmosphere of 10 atm to 200 atm, and at a temperature of 750° C. to 500° C.

1 Claim, No Drawings

AG-SNO$_2$ ELECTRICAL CONTACT MATERIALS

This application is a division of co-pending application Ser. No. 07/477,347, filed Feb. 8, 1990, now U.S. Pat. No. 5,078,810, granted Jan. 7, 1992.

BACKGROUND OF THE INVENTION

This invention relates to electrical contact materials which are used for electrical contacts employed in electrical apparatuses such as switches, breakers, contactors, and the like.

Electrical contact materials dealt with in this invention are particularly those made of Ag-Sn alloys which are made by melting Ag and Sn and which are internally oxidized. Those belong to a different category from those which are prepared by mixing Ag and SnO powders and powdermetallurgically sintering them.

Heretobefore, Ag-Sn oxides alloys in which Ag is a matrix and Sn, solute metal thereof is internal-oxidized to Sn oxides, are widely used as electrical contact materials for the electrical apparatuses of the kind mentioned above.

As a similar electrical contact material, Ag-Cd oxides alloys are known, while electrical contact materials made of Ag-Sn oxides alloys are more extensively employed today in view of the prevention of pollution, since Cd is harmeful to health.

However, there is a serious problem in the manufacture of Ag-SnO alloy contact materials. That is, it is impossible to completely internal-oxidize a total amount of Sn by oxygen which penetrates from the outside of Ag matrix and diffuses into the inside of the matrix, if said Sn is more than about 5 weight % of the Ag matrix. This is a phenomenon commonly accepted by those skilled in this art. And, for example, it is described in the Information (registration No. 1-11) published by DODUCO of West Germany in April, 1966 that in Ag-Sn alloys containing more than 5% of Sn, this Sn can not be oxidized by an internal oxidation method. It is pointed out there that this is because of segregation layers of Sn oxides which are inevitably formed at outer surface areas of such alloys and retard oxygen to penetrate into the alloys for developing the internal oxidation in inner areas. As mentioned above, this has been conceived unanimously by those skilled in industries related to electrical contact materials.

In order to solve this problem, it becomes necessary for a successful internal-oxidation to employ auxiliary solute metals which have higher diffusion velocities or which are more capable to carry oxygen and to convey the oxygen more efficiently into deeper inner areas of Ag matrices. Such auxiliary solute metals are typically In and Bi.

There is issed U.S. Pat. No. 3,933,485 in which Ag-Sn-In system alloys are internal-oxidezed for obtaining modern electrical contact materials, and in which In is used as an auxiliary solute metal for the successful internal-oxidation of the alloys. Said electrical contact materials which are more specifically consisted of 5-10 weight % of Sn, 1.0-6 weight % of In, and a balance of Ag, and are internal-oxidized. They are one of the most excellent contact materials which are industrially used today.

Nevertheless, even when In which can perform well internal-oxidation assisting functions, as explained above, is employed as an auxiliary solute metal, it is not easy to internal-oxidize more than 5% of Sn evenly throughout its Ag matrix. It is sometimes observed that Sn oxides happen to segregate excessively at outer surface areas of the Ag matrix, and such segregation makes subscales which are air-tight, while a depletion layer of Sn oxides is consequently produced in inner areas of the Ag matrix.

It has been noted also that since InO and BiO have a comparatively lower refractoriness, and are comparatively weak metal oxides, it has been desired long since to internal-oxidize Ag-Sn alloys without the employment of In or Bi, if possible.

It will be noted also that compared to secondary Ag-Sn alloys, Ag-Sn-In alloys and Ag-Sn-Bi alloys which are tertiary, are provided with lower electrical conductivities. In this respect too, it is preferable not to use In or Bi as auxiliary elements for the sake of internal-oxidation.

BRIEF SUMMARY OF THE INVENTION

In view of the above, this invention is to provide entirely novel electrical contact materials which are prepared by melting, are consisted of 5-20 weight % of Sn and balance of Ag, only, and are internal-oxidized.

As to a Sn amount in this invention, its minimum is 5 weight % in order to afford the obtained electrical contact materials with efficient refractoriness, and its maximum is 20 weight %, because if Sn is given in an amount more than 20 weight %, the resultant materials will be too brittle. In this invention, though it is characteristic that secondary Ag alloys which are added only by Sn and prepared by melting, are internal-oxidized, one or more elements selected from iron family elements (Fe, Co, and Ni) may be added to said secondary Ag alloys. Such addition is not for the acceleration or assistance of internal-oxidation, but merely for fining or minuting alloy crystalline structures of the resultant alloys. In order to achieve this end, iron family elements will be added at an amount of 0.001-1 weight %.

This invention is also to provide a novel method for preparing the above-mentioned novel electrical contact materials.

To wit, it has been discovered by the present inventors through a large number of experiments that those Ag-Sn (5-20 weight %) alloys which had been impossible to be internal-oxidized, can successfully and completely be internal-oxidized when an oxygen atmosphere for the internal-oxidation is made more than 10 atm. This is novel knowledge and judgement first acquired by the present inventors.

It has been known that in the manufacture of electrical contact materials by internally oxidizing Ag alloys, their Ag matrices are heated so that they become active to induce outside oxygen thereinto. A heating temperature for this end is commonly in a range of 500°-750° C. In this connection, it has been also found by the present inventors that while Ag-Sn (5-20 weight %) alloys can be internal-oxidized in an oxygen atmosphere of more than 10 atm as discovered by them, the above-mentioned heating temperature shall preferably be made comparatively lower within the above-mentioned range of temperature, when the oxygen atmosphere is selected higher. This is because that if the oxygen atmosphere and the heating temperature are both high, Ag matrices become excessively active and consequently take thereinto oxygen too much, resulting in making an oxidation velocity of Sn in the Ag matrices too fast and in producing subscales at surface areas of the Ag matrices on account of the segregation of Sn oxides thereabout. In other words, when the oxygen atmosphere pressure is made comparatively low above 10 atm, the heating temperature will preferably be made high within the above-mentioned range of about 500°-750° C. And, on the contrary, it is preferable that when the oxygen atmosphere is comparatively high above 10 atm, the heating temperature will be made low within the above-mentioned range of internal-oxidation heating temperature.

When Ag alloys of the above-mentioned specific constituents are internal-oxidized in accordance with this invention, it is also preferable to conduct the internal-oxidation at such condition where the Ag alloys are kept at a solid phose not involving any liquid phase, since if the alloys become liquid even partially, metal oxides precipitated by then might move about floatingly towards surface areas of the alloys and subsequently make subscales thereabout.

In view of the above, when the heating temperature is sided low within the above-mentioned range of temperature or near to its minimum temperature of about 500° C., it is better to make the oxygen atmosphere as much as higher. But, in order to prevent the alloys from becoming liquid and on account of safe and economic industrial and commercial operations, the maximum oxygen atmosphere preferably employable in this invention will be up to about 200 atm. In other words, when Ag-Sn (5-20 weight %) alloys made by melting are internal-oxidized in accordance with this invention, the lower and upper or minimum and maximum oxygen atmosphere shall preferably be 10 atm and 200 atm, and its heating temperature shall preferably be in a range of about 750° C. to about 500° C.

PREFERRED EMBODIMENTS

This invention is explained in a further concrete manner in the following examples.

(1) Ag-Sn 6 weight %

(2) Ag-Sn 6 weight %-Ni 0.2 weight %

The above constituents (1) and (2) were melted and made to ingots of 120 mm in diameter and 40 mm in length. The ingots were hot-extruded into square bars of 30 mm in thickness and 50 mm in width. The bars were then cut to a length of 500 mm each, and their upper and lower surfaces were shaved by a thickness of 3 mm each to obtain square bars of 24 mm in thickness, 510 mm in width, and 500 mm in length.

To each lower surface of the square bars, there were bounded pure silver of 2.5 mm in thickness. They were rolled by pressure so that they had thickness of 1.2 mm. By punching them by a punch having a cutting hole of 6 mm in diameter, disk-shaped contact materials backed by the pure silver and having 6 mm diameter and 1.2 mm thickness were obtained.

They were internal-oxidized by heating them 700° C. for 48 hours in an oxygen atmosphere of 25 atm.

Vertical sections of the resulted contact materials were observed through a microscope to the effect that there was produced no subscales at and about surface areas of the materials, and that Sn constituents were completely oxidized. It was observed also that particles of Sn oxides were extremely fine and were precipitated evenly in their Ag matrices, irrespectively of Ag grain boundaries of the Ag matrices. Precipitation distribution and structures of Sn oxides were thus extremely fine, as if they were prepared by powder-metallurgical methods.

In order to make a comparison, the following alloy (3) was made. Contact materials which are made by the internal oxidation of said alloy (3) are known as one of the today's best electrical contacts having extremely excellent contact characteristics and performance.

(3) Ag-Sn 6 weight %-In 1 weight %-Ni 0.2 weight %

This alloy which had been prepared by melting, was processed into disk-shaped contact materials same to those specified in the above (1) and (2) alloys. The disk-shaped contacts were internal-oxidized by heating them to 620° C. for 24 hours at a normal oxygen atmosphere of 1 atm.

The resultant contacts (3) were observed by a microscope, similarly to the contacts (1) and (2). It was found that Sn was completely internal-oxidized in these contacts too, while they were precipitated mostly along Ag grain boundaries, and were noticeably coarser than those of the contacts (1) and (2).

Hardness (HRP) and electrical conductivity (IACS%) of the above internal-oxidized contact materials (1), (2), and (3) were as follows.

| | Hardness | Electrical conductivity |
|---|---|---|
| (1) | 78 | 72 |
| (2) | 80 | 70 |
| (3) | 95 | 55 |

Welding times by anti-welding tests (conducted under electric voltage of DC 240 V, initial electric current (discharge current from a condensor electric current) of 700 A, contact pressure of 200 g, and test cycles of 20) were as follows.

(1) 0
(2) 0
(3) 0

Amounts of consumption (mg) by ASTM test method (by electric voltage of AC 200 V, electric current of 50 A, contact pressure of 400 g, and releasing force of 600 g) were as follows.

(1) 10
(2) 8
(3) 15

As described and explained above in detail, this invention can provide absolutely novel electrical contact materials made of Ag-Sn (5-20 weight %) alloys which has been prepared by melting and internal-oxidized. As readily known form the above test data, the electrical contact materials made in accordance with this invention are substantially secondary Ag-Sn alloy provided with Sn oxides precipitated extremely finely and evenly in its Ag matrix and, consequently having excellent contact properties including their improved electrical conductivities.

We claim:

1. Ag-$Sno_2$ electrical contact materials made of Ag alloys consisting of more than 5 weight % and up to 20 weight % of Sn, 0.001 to 1 weight % of one or more elements selected from the iron family elements of Fe, Co, and Ni, and the balance of Ag, said alloys having been internal-oxidized in an oxygen atmosphere of more than 10 atm. and up to 200 atm. and at a temperature of 500° C. to 750° C. where the alloys were kept at a solid phase not involving any liquid phase.

* * * * *